US012091929B2

(12) United States Patent
Cox et al.

(10) Patent No.: US 12,091,929 B2
(45) Date of Patent: Sep. 17, 2024

(54) SUBSEA GREASE INJECTION SYSTEM

(71) Applicant: TRENDSETTER ENGINEERING, INC., Houston, TX (US)

(72) Inventors: Brent Cox, Houston, TX (US); Stephen Kruppa, Houston, TX (US); David Older, Houston, TX (US)

( * ) Notice: Subject to any disclaimer, the term of this patent is extended or adjusted under 35 U.S.C. 154(b) by 0 days.

(21) Appl. No.: 18/469,154

(22) Filed: Sep. 18, 2023

(65) Prior Publication Data

US 2024/0093565 A1 Mar. 21, 2024

Related U.S. Application Data

(60) Provisional application No. 63/407,753, filed on Sep. 19, 2022.

(51) Int. Cl.
*E21B 33/076* (2006.01)

(52) U.S. Cl.
CPC ..... *E21B 33/076* (2013.01)

(58) Field of Classification Search
CPC ..... E21B 33/076
See application file for complete search history.

(56) References Cited

U.S. PATENT DOCUMENTS 3,640,299 A 2/1972 Nelson
4,036,247 A 7/1977 Baugh
4,649,704 A 3/1987 Marsh
4,821,799 A 4/1989 Wong
4,943,187 A * 7/1990 Hopper ..... B63C 11/52 166/341
4,951,745 A 8/1990 Gentry
5,024,250 A * 6/1991 Nakamura ..... F15B 1/24 138/104
6,192,680 B1 * 2/2001 Brugman ..... F15B 21/006 60/413
6,202,753 B1 3/2001 Baugh
7,891,429 B2 * 2/2011 Boyce ..... E21B 33/076 166/381
8,220,553 B2 7/2012 Crawford
8,281,897 B1 10/2012 Lugo
(Continued)

FOREIGN PATENT DOCUMENTS

EP 2607611 A1 6/2013

*Primary Examiner* — Aaron L Lembo
(74) *Attorney, Agent, or Firm* — Egbert, McDaniel & Swartz, PLLC

(57) ABSTRACT

A subsea grease injection system has a grease accumulator containing a supply of grease, a hydraulic accumulator, a flowline connected to an outlet of the grease accumulator so as to allow discharge of grease from the supply to flow therethrough, and a subsea structure connected to the flowline. The hydraulic accumulator is in fluid communication with the grease accumulator such that the displacement of hydraulic fluid from the hydraulic accumulator causes a corresponding discharge of grease from the grease accumulator. The subsea structure receives grease from the flowline. The grease accumulator is a piston and cylinder in which the piston is received in the cylinder to define first and second compartments. The supply of grease is in the first compartment. The hydraulic fluid fills an interior of the second compartment. This avoids the use of hydraulic conduits from the surface such that only power and communications are from the surface.

16 Claims, 2 Drawing Sheets

(56) References Cited

U.S. PATENT DOCUMENTS

| | | | | |
|---|---|---|---|---|
| 8,833,465 | B2 * | 9/2014 | Kotrla | F15B 21/006 166/363 |
| 8,857,520 | B2 * | 10/2014 | Hoffman | E21B 33/0355 166/341 |
| 8,955,595 | B2 * | 2/2015 | Emecheta | E21B 33/0355 60/415 |
| 10,180,148 | B2 * | 1/2019 | Coppedge | E21B 34/04 |
| 10,240,430 | B2 * | 3/2019 | McCormick | E21B 34/04 |
| 2007/0240882 | A1 | 10/2007 | Leonardi | |
| 2008/0104951 | A1 | 5/2008 | Springett | |
| 2009/0151956 | A1 | 6/2009 | Johansen | |
| 2012/0043089 | A1 * | 2/2012 | Hoffman | E21B 33/064 166/365 |
| 2012/0324876 | A1 * | 12/2012 | Fuselier | E21B 33/0355 60/413 |
| 2018/0038390 | A1 * | 2/2018 | Carrillo | F15B 21/10 |
| 2018/0371838 | A1 * | 12/2018 | Tran | F16C 32/0648 |
| 2020/0141203 | A1 * | 5/2020 | Deul | E21B 33/064 |

* cited by examiner

SUBSEA GREASE INJECTION SYSTEM

RELATED U.S. APPLICATIONS

The present application claims priority from U.S. Provisional Patent Application Ser. No. 63/407,753, filed on Sep. 19, 2022.

BACKGROUND OF THE INVENTION

1. Field of the Invention

The present invention relates to subsea systems in which grease is delivered to various subsea components of offshore oil and gas production and drilling systems, including intervention systems and well access packages. More particularly, the present invention relates to the control of valves associated with grease accumulators and with hydraulic accumulators.

2. Description of Related Art Including Information Disclosed Under 37 CFR 1.97 and 37 CFR 1.98

As well drilling operations progress into deeper waters in the search for new oil and gas reserves, new subsea equipment must be developed. Valves are the main flow control devices for this equipment. Since handwheel-operated valves cannot easily be used below the surface of bodies of water, hydraulically-actuated valves (and other pressure and flow control devices) are typically used to control the flow of oil and gas from underground reserves.

It is important to be able to provide grease to wireline tooling. The grease provides a seal for such wireline tooling. Ultimately, the subsea pressure control head (or greasehead) requires a substantial amount of grease so as to effectively operate.

In the past, it has been necessary to supply grease to such subsea operations by pumping grease or hydraulics through an extremely long umbilical. Typically, the grease will be pumped from the vessel to its desired location in the subsea equipment. Unfortunately, it is often difficult to pump the grease through such long umbilicals since the pressure and temperature in the subsea operations will cause the grease to become too viscous to be effectively pumped. To avoid this problem, it is desirable to pump grease to the equipment from a location as close as possible to the equipment.

In the past, accumulators have been used to supply fluids to the subsea equipment. Pressurized hydraulic fluid is typically generated by high-pressure, low-volume, positive-displacement pumps. Since a large volume of hydraulic fluid is required to activate most subsea valves, and other pressure control devices, pressurized hydraulic fluid reservoirs (or "accumulators") are used in conjunction with the low-volume positive-displacement pumps. These accumulators usually take the form of a hollow metal spherical or cylindrical canister partially filled with a pressurized inert gas, such as nitrogen, and partially-filled with a pressurized hydraulic fluid. In operation, these accumulators are initially pre-charged with pressurized nitrogen prior to being submerged. The pre-charged pressure usually is equal to the anticipated pressure of the water that will be encountered at the depth of submersion of the accumulator. The pre-charging is necessary to provide a compressible medium that will accept a quantity of power fluid upon charging, and then expel it upon demand.

In the past, the subsea valves associated with such accumulators have been hydraulically controlled from a surface location. This hydraulic control of the valves requires at least one hydraulic umbilical to extend from a surface location. The hydraulic umbilicals often have many problems when operating in deep water. In certain circumstances, hydrates can develop in such hydraulic umbilicals. This can cause a blockage or reduction of fluid flow in the umbilical. In other circumstances, the hydraulic umbilical would provide an imprecise control of the subsea valve. In any event, these hydraulic umbilicals are quite heavy to transport and to deploy. As such, a need has developed in order to avoid the use of hydraulic power for the control of the valves associated with grease accumulators.

In the past, various patents have issued relating to fluid accumulators for use in subsea applications. For example, U.S. Pat. No. 4,649,704, issued on Mar. 17, 1987 to G. L. Marsh, teaches a pressurized fluid accumulator adapted to be connected to a subsea valve actuator on a drilling wellhead assembly. There is a pressure-compensated piston located in a first hydraulic cylinder. The movement of this piston causes pressurized hydraulic fluid to be delivered in sufficient volume to activate a subsea hydraulically-activated valve. The first piston is connected to and driven by a second piston contained in a second hydraulic cylinder. The charging and accumulation of pressurized hydraulic fluid in the first cylinder causes a nearly absolute vacuum to be developed under the second piston. The pressure differential between this vacuum and the prevailing sea pressure is used to move the first piston during delivery of the hydraulic fluid to the actuator of the hydraulically-activated valve.

U.S. Pat. No. 6,202,753, issued on Mar. 20, 2001 to B. F. Baugh, describes a subsea accumulator and method of operation. This accumulator uses a differential between a high-pressure ambient pressure source, such as sea water pressure, and a low-pressure source, such as a chamber holding vacuum or atmospheric pressure, to provide storage and delivery of hydraulic power for operation of equipment.

U.S. Patent Publication No. 2007/0240882, published on Oct. 18, 2007 to Leonardi et al., provides an accumulator for subsea equipment. This accumulator apparatus comprises a housing and an accumulator within the housing at the first end of the housing. The accumulator has first and second chambers that are hermetically-sealed from one another. A pressurized gas in the first chamber and a pressurized fluid in the second chamber are arranged within the accumulator. A third chamber in the housing abuts the accumulator and contains fluid. A movable piston is located within the housing proximate the second end of the housing. Ambient pressure is communicated to one end of the piston. Ambient pressure plus the pressure in the second chamber is communicated to the second end of the piston. The cross-sectional areas of the two ends of the piston are selected to optimize the pressure at which the piston begins to expel fluid from the second chamber.

U.S. Pat. No. 3,640,299, issued on Feb. 8, 1972 to N. A. Nelson, describes a subsea wellhead control system. This system has a single protective conduit connected at one end thereof to a control facility while its other end terminates in a connection structure located adjacent or attached to a remotely located wellhead. Suitable actuator control conduits extend from a plurality of fluid-controlled wellhead valve actuators and are connected in fluid communication to the connection structure. The valve accumulators are energized by the actuating fluid responsive to actuation of the pilot valves. An accumulator and pressure-balancing circuit are communicated to the fluid circuitry of each of the valve actuators in order to allow quick energized and deenergized actuation of the valve actuators. Fluid pressure is transferred from the accumulator and pressure-balancing circuitry to the actuator fluid supply of the fluid system upon reduction of pressure in the actuator fluid supply and such transfer may be aided by the hydrostatic head of the sea water in which the system is submerged.

U.S. Patent Publication No. 2008/0104951, published on May 8, 2008 to F. B. Springett, shows a subsea pressure accumulator system which has a body with three or more interior chambers. The body has a first body end with a first opening, and a second body end with a second opening. An amount of operational power fluid in the first chamber and an amount of pressurized gas in the second chamber move a piston assembly for moving power fluid from the body to operate an apparatus. The piston assembly has a cavity within a piston end for containing additional pressurized gas for moving the piston assembly.

U.S. Pat. No. 4,036,247, issued on Jul. 19, 1977 to B. F. Baugh, discloses a multi-pressure, single line supply system for purpose of conveying fluid from a single subsea supply conduit in order provide a fluid supply for each of a plurality of subsea well control apparatus that require fluid supplies at different pressure levels. A fluid receiver receives fluid under pressure from the single subsea supply conduit. A regulator regulates fluid flow from the receiver to charge one or more accumulators with fluid at desired pressure levels and to control injection of the fluid through an injection line into a subsea well flowline.

U.S. Pat. No. 8,281,897, issued on Oct. 9, 2012 to the present applicant, describes a grease accumulator apparatus for use in subsea applications. This grease accumulator apparatus has a bottle with an internal chamber, a plunger positioned within the internal chamber, and an end cap assembly affixed to one end of the bottle. The end cap assembly has an indicator member slidably connected thereto. The indicator member is cooperative with the plunger such that an end of the indicator member moves outwardly of the end cap assembly as the plunger moves in the bottle toward the end cap assembly. The end cap assembly has a body with a housing affixed to one end thereof. The housing has a hydraulic fluid inlet and a hydraulic fluid outlet. The indicator member is movable between a position in which the inlet and outlet are fluidically connected in a position in which fluid flow is blocked between the inlet and the outlet.

U.S. Pat. No. 8,220,553, issued on Jul. 17, 2012 to N. Crawford, teaches a subsea grease system for supplying grease to maintain a sealed well during deployment of line. The subsea grease cartridge has a subsea assembly, first and second grease containers filled with grease, a pump, a switch, and a restoring device to replenish the grease containers.

U.S. Pat. No. 4,821,799, issued on Apr. 18, 1989 to K. P. Wong, shows a grease injection control system for sealing around a wireline run into or pulled from wells. The system includes a grease control head with a line wiper mounted on the wellhead and a grease injection control system. The grease injection control system supplies grease continuously at a constant pressure for injection into the grease control head. The control system utilizes a piston pump to supply grease to a grease chamber in a pressurizing accumulator. The accumulator has another chamber connected to a remote pressure source, which is separated from the grease chamber by a movable partition. Constant pressure from the remote source is transmitted through the movable partition to grease in the grease chambers in order to maintain a constant pressure on the grease injected into the grease control head.

U.S. Patent Application Publication No. 2009/0151956, published on Jun. 18, 2009 to Johansen et al., provides a subsea lubricator system which includes a lubricator tube adapted to be positioned subsea above a subsea well, a pressure control head adapted to be positioned above the lubricator tube, at least one pressure sensor adapted for sensing at least one of a pressure in the subsurface well or an ambient seawater pressure proximate the pressure control head, and at least one pump that is adapted to be positioned subsea to inject a lubricant into the pressure control head at a pressure that is greater than the sensed pressure.

U.S. Pat. No. 4,951,745, issued on Aug. 28, 1990 to Gentry et al., describes a grease injector for subsea wells. A hydraulically-actuated stuffing box for use on a lubricator assembly or a grease injector section to seal around flexible line run through the lubricator assembly into an underwater well is described. The stuffing box has a piston on which control fluid acts, compressing a resilient seal in the stuffing box to seal around the line. The piston is biased to a position not compressing the seal to prevent hydrostatic pressure of the control fluid from compressing the seal to seize the line in deep water. The stuffing box and grease injector section have a through passageway for the line. Both have an internal valve which automatically prevents surrounding water flow into a well when no flexible line is in the passageway.

Canadian Patent Application No. 2 607 611, published on Jun. 26, 2013 to Davey et al., shows a grease delivery system for delivering grease to a location. This grease delivery system has first and second grease reservoirs, a first grease reservoir output for outputting grease from the first reservoir, a second grease reservoir output for outputting grease from the second reservoir, and means for causing increased output from each of the first and second reservoirs along the respective grease reservoir output. The system further comprises a common grease output for delivering grease to the location. The common grease output is connected to each of the first and second grease outputs such that grease may be output simultaneously from the first and second reservoirs as to the common grease output.

It is an object of the present invention to provide a subsea grease injection system that avoids the use of hydraulic conduits from a surface location in order to pressurize and to inject grease into a pressure control head.

It is another object of the present invention to provide a subsea grease injection system that only requires electric power and communication from a surface vessel in a riserless grease delivery system.

It is another object of the present invention provide a subsea grease injection system that allows for subsea well control for any well.

It is another object of the present invention to provide a subsea grease control system that can be utilized in association with any mechanical tool.

It is another object of the present invention to provide a subsea grease injection system that can have single or multiple grease injection supply circuits.

It is still further object to the present invention to provide a subsea grease injection system which can have single or multiple packoffs.

It is another object of the present invention to provide a subsea grease injection system that can utilize subsea-located hydraulic accumulators for energizing grease released from a grease accumulator.

It is still a further object of the present invention to provide subsea-located hydraulic accumulators for energizing annular packoffs with stored hydraulic energy.

It is another object of the present invention to avoid the need for hydraulic downlines from a surface location such that only power and communications are directed from the surface location.

These and other objects and advantages of the present invention will become apparent from a reading of the attached specification and appended claims.

BRIEF SUMMARY OF THE INVENTION

The present invention is a subsea grease injection system that comprises a grease accumulator containing a supply of grease therein, a hydraulic accumulator having a hydraulic fluid therein, a flowline connected to an outlet of the grease accumulator, and a subsea structure connected to the flowline. The hydraulic accumulator is in fluid communication with the grease accumulator such that a displacement of the hydraulic fluid from the hydraulic accumulator causes a corresponding discharge of grease from the supply of grease from the grease accumulator. The flowline allows the discharge of grease from the supply of grease to flow therethrough. The subsea structure receives the grease from the flowline. The subsea structure, in particular, can be a pressure control head having a packoff hydraulic control therein.

The grease accumulator is a piston-and-cylinder assembly. The piston is received in the cylinder so as to define a first compartment and a second compartment. The supply of grease is in the first compartment. The hydraulic fluid from the hydraulic accumulator fills an interior of the second compartment. The flowline is connected to the first compartment. The hydraulic accumulator is connected by conduit to the second compartment of the cylinder of the grease accumulator.

A flow and pressure control device is mounted on the conduit. The flow and pressure control device regulates a flow rate and a pressure of the hydraulic fluid flowing through the conduit to the first compartment. A hydraulic accumulator recharge is connected by a line to the hydraulic accumulator. The hydraulic accumulator recharge is adapted to allow hydraulic fluid from a remotely-operated vehicle or other subsea container to be introduced into the hydraulic accumulator. A valve is positioned on the line between the hydraulic accumulator recharge and the hydraulic accumulator. The valve is movable between an open position and a closed position. The open position allows the hydraulic fluid to be introduced in the hydraulic accumulator. The closed position blocks hydraulic fluid from passing outwardly of the hydraulic accumulator to the hydraulic accumulator recharge.

The hydraulic accumulator is pressurized such that hydraulic fluid flows to the grease accumulator when the flow and pressure control device is opened.

Another hydraulic accumulator can be positioned remotely from the pressure control head. This another hydraulic accumulator is adapted to controllably pass hydraulic fluid to the packoff hydraulic control of the pressure control head. This another hydraulic accumulator is pressurized. A flow and pressure control device is connected to a hose between the another hydraulic accumulator and the pressure control head. The flow and pressure control device is adapted to control a flow rate and a pressure of the hydraulic fluid flowing to the packoff hydraulic control. A hydraulic accumulator recharge is connected by a line to the another hydraulic accumulator. This hydraulic accumulator recharge is adapted to allow hydraulic fluid to be introduced into the another hydraulic accumulator. The result of this configuration is that no hydraulic downlines are required from the surface location. The hydraulic are provided subsea. Only power and communication are directed from the surface location.

The present invention is also a subsea lubrication system that comprises a wellhead, a well control package mounted onto the wellhead, a lubrication control package connected by a subsea connector to the well control package, a pressure control head connected by a subsea connector to the lubrication control package, and an electrical power and communication downline connected to the well control package. The lubrication control package has a grease accumulator containing the supply of grease therein, a hydraulic accumulator having a hydraulic fluid therein, and a flowline connected to an outlet of the grease accumulator so as to allow the discharge of grease from the supply of grease to flow therethrough. The hydraulic accumulator is in fluid communication with the grease accumulator such that a displacement of the hydraulic fluid from the hydraulic accumulator causes a corresponding discharge of grease from the supply of grease from the grease accumulator. The lubrication control package is connected by a hose to the pressure control head.

The well control package and the lubrication control package and the lubricator section and the pressure control head are adapted to allow a subsea tool to pass therethrough.

The grease accumulator is a piston-and-cylinder assembly. The piston is received in the cylinder so as to define a first compartment and a second compartment. The supply of grease is in the first compartment. The hydraulic fluid from the hydraulic accumulator fills an interior of the second compartment. The flowline is connected to the first compartment. The hydraulic accumulator is connected by a conduit to the second compartment of the cylinder of the grease accumulator. A flow and pressure control device is mounted onto the conduit. The flow and pressure control device regulates a flow rate and a pressure of the hydraulic fluid flowing through the conduit to the first compartment of the grease accumulator.

A hydraulic accumulator recharge is connected by a line to the hydraulic accumulator. The hydraulic accumulator recharge is adapted to allow hydraulic fluid from a remotely-operated vehicle or other subsea container to be introduced into the hydraulic accumulator. A valve is positioned on the line between the hydraulic accumulator recharge and a hydraulic accumulator. The valve is movable between an open position and a closed position. The open position allows the hydraulic fluid to be introduced into the hydraulic accumulator. The closed position blocks hydraulic fluid from passing outwardly of the hydraulic accumulator to the hydraulic accumulator recharge.

Another hydraulic accumulator can be positioned remotely from the pressure control head or stowed on a lubrication control package. This another hydraulic accumulator is adapted to controllably pass hydraulic fluid to the packoff hydraulic control of the pressure control head. A flow and pressure control device is connected to the hose between the another hydraulic accumulator and the pressure control head. The flow and pressure control device is adapted to control a flow rate and a pressure of the hydraulic fluid flowing to the packoff hydraulic control of the pressure control head.

The present invention is a riserless grease delivery system which only requires electric power and communication from the surface vessel. No hydraulic conduit or a subsea hydraulic supply fluid running from the surface to subsea is required in order to inject the grease into the pressure control head while running any tool into the subsea well. The riserless annular packoff control system only requires electric power and communication from the surface vessel. No hydraulic conduit or subsea hydraulic fluid supply running from the surface to subsea is required to control the packoffs on the pressure control head while running any tool into the subsea well.

All previous interventions utilizing riserless subsea pressure control heads must have a hydraulic supply conduit from surface to subsea while running a tool into the subsea well. Such a tool can be used to perform workover or intervention activities into the well. The present invention includes grease transfer canisters powered by subsea stored hydraulic accumulation for the grease injection/delivery into the pressure control head. Similarly, annular packoffs are operated using the subsea stored hydraulic accumulation.

The subsea grease injection or delivery does not require a hydraulic conduit or additional subsea hydraulic fluid supplies deployed from the surface in order to pressurize the grease. The subsea annular packoff system does not require a hydraulic conduit or additional subsea hydraulic fluid supplies deployed from the service in order to control the annual packoffs. The present invention can provide subsea well control on any subsea well. The present invention can cover any mechanical tool used for perform workover and intervention activities on subsea oil and gas wells. The present invention can include single or multiple grease injection/supply circuits. The present invention can also include single or multiple annular packoffs. The subsea-located hydraulic accumulators are utilized for energizing the grease. The subsea-located hydraulic accumulators can also be utilized for energizing the annular packoffs within the pressure control head.

This foregoing Section is intended to describe, with particularity, the preferred embodiments of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
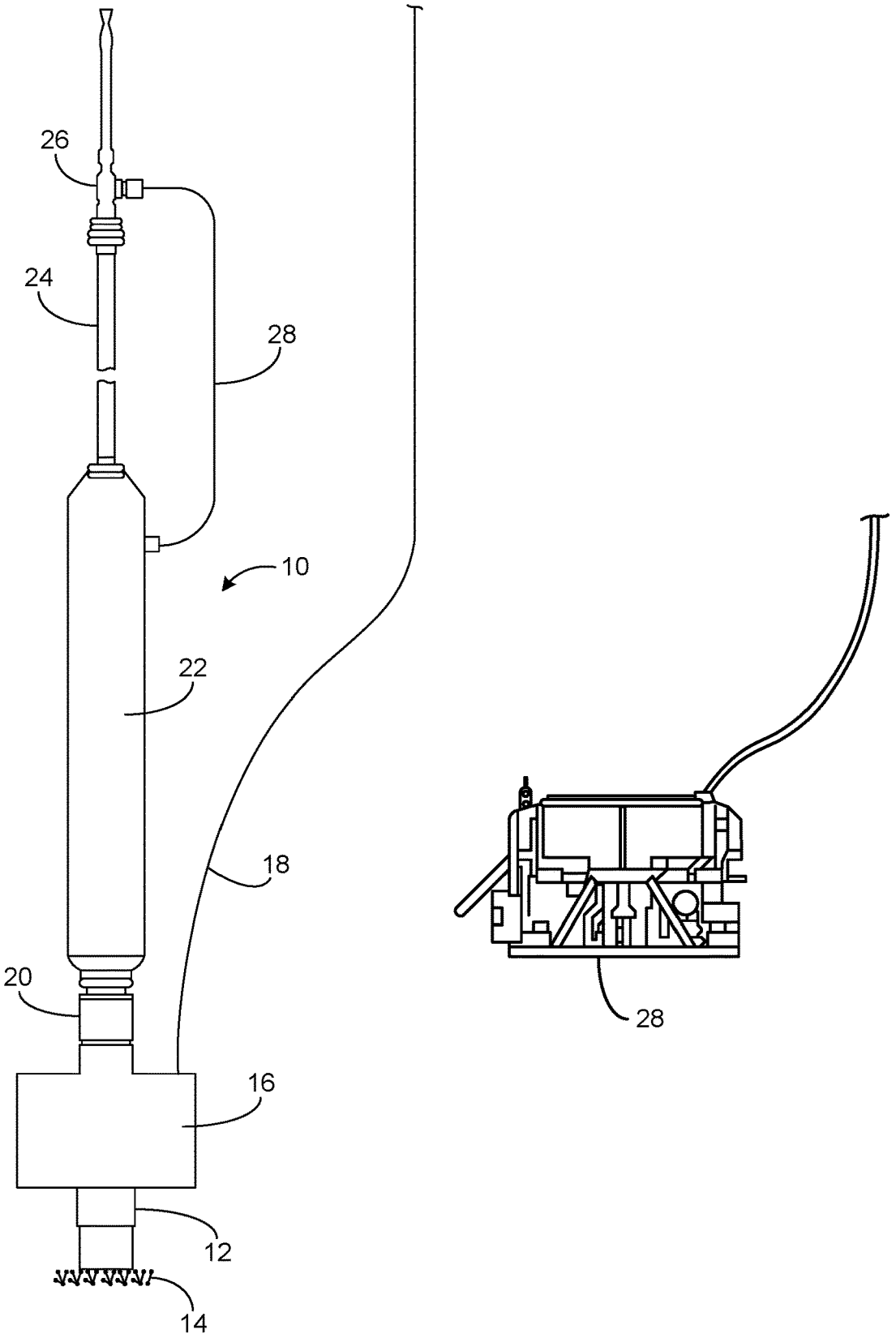
FIG. 1 is a diagrammatic illustration of the subsea lubrication system of the present invention.

Referring to FIG. 1, there is shown the subsea lubrication system 10 in accordance with the teachings of the present invention. The subsea lubrication system 10 has a subsea XT or wellhead 12 located at seafloor 14. A well control package 16 is positioned on the subsea XT or wellhead 12. An electrical power and communication downline 18 extends from a surface location in order to control the functions of the well control package 16. Subsea connector 20 is connected to an upper end of the well control package. The lubrication control package 22 is connected to the subsea connector 20 at a lower end thereof. A lubricator section 24 is connected to an upper end of the lubrication control package 22. The pressure control head 26 is located in an opposite end of the lubricator section 24 from the lubrication control package 22. A hose 28 extends from the lubrication control package 22 to the pressure control head 26 in order to control the operation of the packoff hydraulic control therein and to provide lubrication to the interior of the pressure control head 26 and to the lubricator section 24. When each of the items in FIG. 1 is open, a subsea tool can be introduced into the subsea XT or wellhead 12. An ROV 28 can be provided so as to control functions of the various items within system 10 and/or to deliver hydraulic fluid and/or grease to the lubrication control package 22.

Figure 2:
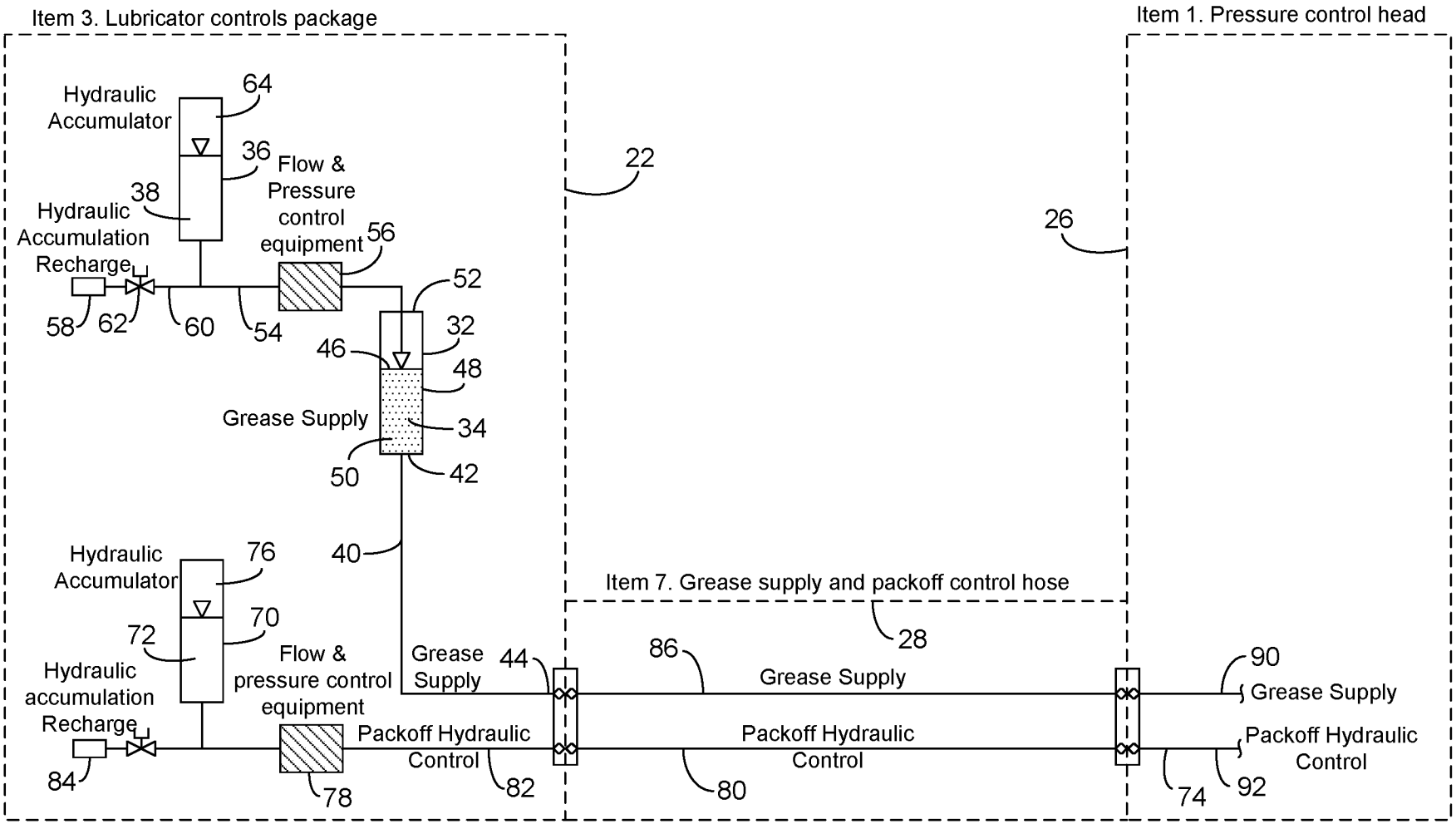
FIG. 2 is a schematic diagram showing the subsea lubrication system of the present invention.

FIG. 2 is a schematic diagram showing the operation of the lubrication control package 22, the grease supply and packoff control hose 28 and the pressure control head 26.

The lubrication control package 22 includes a grease accumulator 32 therein. This grease accumulator 32 includes a supply of grease 34 in an interior thereof. A hydraulic accumulator 36 has a hydraulic fluid 38 therein. Hydraulic accumulator 36 is in fluid communication with the grease accumulator 32 such that a displacement of the hydraulic fluid 38 within the hydraulic accumulator 36 causes a corresponding discharge of grease from the supply of grease 34 from the grease accumulator 32. A flowline 40 is connected to an outlet 42 of the grease accumulator. Flowline 40 allows the discharge of grease from the supply of grease 34 to flow therethrough. The flowline 40 can be in the nature of the resupply and packoff control hose 28 (as shown in FIG. 1). Alternatively, the flowline 40 can connect by connector 44 to the grease supply and packoff control hose 28 (in the manner shown in FIG. 2).

The grease accumulator 32 is a piston-and-cylinder assembly. A piston 46 is received in the cylinder 48 so as to define a first compartment 50 and a second compartment 52. The supply of grease 34 is in the first compartment 50. The hydraulic fluid 38 from the hydraulic accumulator 36 fills an interior of the second compartment 52. Flowline 40 is connected to the first compartment 50. The hydraulic accumulator 36 is connected by a conduit 54 to the second compartment 52 of the cylinder 48 of the grease accumulator 32.

A flow and pressure control device 56 is mounted on the conduit 54. The flow and pressure control device 56 regulates a flow rate and a pressure of the hydraulic fluid 38 flowing through the conduit 54 to the first compartment 52.

A hydraulic accumulator recharge 58 is connected by a line 62 the hydraulic accumulator 36. The hydraulic accumulator recharge 58 is adapted to allow hydraulic fluid from ROV 28 (or other subsea container) to be introduced into the hydraulic accumulator 36. A valve 62 is positioned on the line 60 between the hydraulic accumulator recharge 58 and the hydraulic accumulator 36. The valve 62 is movable between an open position and a closed position. The open position allows hydraulic fluid to be introduced into the hydraulic accumulator 36. The closed position blocks hydraulic fluid from passing outwardly of the hydraulic accumulator 36 toward the hydraulic accumulator recharge 58.

The hydraulic accumulator 36 is pressurized in area 64 such that hydraulic fluid 38 flows to the grease accumulator 32 when the flow and pressure control device 56 is opened. The pressurization of the hydraulic fluid in a hydraulic accumulator 36 automatically allows fluid to flow, as needed, to the grease accumulator 32.

The lubrication control package 22 also includes another hydraulic accumulator 70 positioned remotely from or adjacent to the pressure control head 26. This another hydraulic accumulator 70 is adapted to controllably pass hydraulic fluid 72 to the packoff hydraulic control 74 of the pressure control head 26. This another hydraulic accumulator 70 has a pressurized area 76. This another hydraulic accumulator 70 is similar to hydraulic accumulator 36 in that the pressurized area 76 urges the hydraulic fluid outwardly. The flow of hydraulic fluid outwardly is controlled by the flow and pressure control device 78 connected by a hose 80 between the another hydraulic accumulator 70 and the pressure control head 26. A flow and pressure control device 78 is adapted to control a flow rate and a pressure of the hydraulic fluid 72 flowing to the packoff hydraulic control 74. The hose 80 can extend continuously between the hydraulic accumulator 70 and the packoff hydraulic control 74 of the pressure control head 26 or it can be connected at area 44 to another line 82 extending to the flow and pressure control device 78 and the hydraulic accumulator 70. A hydraulic accumulator recharge 84 is connected by a line to the another hydraulic accumulator 70. The hydraulic accumulator recharge 84 is adapted to allow hydraulic fluid to be introduced into the another hydraulic accumulator 70.

The grease supply and packoff control hose extends between the lubrication control package 22 and the pressure control head 26 in the manner shown in FIG. 1. In particular, when both of the hydraulic accumulators 36 and 70 are employed, a grease supply hose 86 and a packoff hydraulic control hose 80 can be used as part of the grease supply and packoff control hose assembly 28. These can extend to the pressure control head 26 and be connected to the grease supply line 90 and the packoff hydraulic control line 92 for the control of functions and lubrication of the pressure control head 26.

The present invention provides a riserless grease delivery system which only requires electric power and communication from the surface vessel. No hydraulic conduit or subsea hydraulic fluid supply running from the surface to the subsea location is required in order to inject the grease into the pressure control head 26 while running any tool into the subsea well. The present invention only requires electric power and communication from the surface vessel. No hydraulic conduit or subsea hydraulic fluid supply running from the surface to the subsea location is required to control the packoffs on the pressure control head while running any tool into the subsea well. The present invention has grease transfer canisters powered by subsea stored hydraulic accumulation for the injection and delivery of grease into the pressure control head. The annular packoff can be operated using subsea-stored hydraulic accumulation.

The present invention employs a surface-deployed electric source (not shown) so as to control the various valves in the subsea control module. This can be in the form of separate electrical umbilicals or through a remotely-operated vehicle. The present invention avoids the use of hydraulic umbilicals.

The subsea hydraulic accumulator is charged by the remotely-operated vehicle during the initial installation and can be recharged regularly as needed. The remotely-operated vehicle is not required to be connected to the accumulator in order to carry out the control a flow of grease circuits or packoff circuits. The present invention is a riserless grease delivery system which only requires electric power and communication from the surface vessel. No hydraulic conduit or a subsea hydraulic supply fluid running from the surface to subsea is required in order to inject the grease into the pressure control head while running any tool into the subsea well. The riserless annular packoff control system only requires electric power and communication from the surface vessel. No hydraulic conduit or subsea hydraulic fluid supply running from the surface to subsea is required to control the packoffs on the pressure control head while running any tool into the subsea well.

All previous interventions utilizing riserless subsea pressure control heads must have a hydraulic supply conduit from surface to subsea while running a tool into the subsea well. Such a tool can be used to perform workover or intervention activities into the well. The present invention includes grease transfer canisters powered by subsea stored hydraulic accumulation for the grease injection/delivery into the pressure control head. Similarly, annular packoffs are operated using the subsea stored hydraulic accumulation.

The subsea grease injection or delivery does not require a hydraulic conduit or additional subsea hydraulic fluid supplies deployed from the surface in order to pressurize the grease. The subsea annular packoff system does not require a hydraulic conduit or additional subsea hydraulic fluid supplies deployed from the service in order to control the annual packoffs. The present invention can provide subsea well control on any subsea well. The present invention can cover any mechanical tool used for perform workover and intervention activities on subsea oil and gas wells. The present invention can include single or multiple grease injection/supply circuits. The present invention can also include single or multiple annular packoffs. The subsea-located hydraulic accumulators are utilized for energizing the grease. The subsea-located hydraulic accumulators can also be utilized for energizing the annular packoffs within the pressure control head.

The foregoing disclosure and description of the invention is illustrative and explanatory thereof. Various changes in the details of the illustrated construction can be made is the scope of the present invention without departing from the true spirit of the invention. The present invention should only be limited by the following claims and their legal equivalents.

We claim:

1. A subsea grease injection system comprising:

a grease accumulator containing a supply of grease therein, said grease accumulator having a piston and a cylinder, the piston being received in the cylinder so as to define a first compartment and a second compartment therein, the supply of grease being in the first compartment;

a hydraulic accumulator having a hydraulic fluid therein, said hydraulic accumulator being in fluid communication with said grease accumulator such that a displacement of the hydraulic fluid from said hydraulic accumulator causes a corresponding discharge of grease from the supply of grease from said grease accumulator, the hydraulic fluid from said hydraulic accumulator filling an interior of the second compartment;

a flowline connected to an outlet of said grease accumulator so as to allow the discharge of grease from the supply of grease to flow therethrough;

a subsea structure connected to said flowline, said subsea structure receiving the grease from said flowline; and a flow and pressure control device mounted on the conduit, said flow and pressure control device regulating a flow rate and a pressure of the hydraulic fluid flowing through the conduit to the second compartment of said grease accumulator, said hydraulic accumulator being pressurized such the hydraulic fluid flows without a pump to said grease accumulator when said flow and pressure control device is opened.

2. The subsea grease injection system of claim 1, said flowline being connected to the first compartment of said grease accumulator.

3. The subsea grease injection system of claim 1, further comprising:

a hydraulic accumulator recharge connected by a line to said hydraulic accumulator, said hydraulic accumulator recharge adapted to allow hydraulic fluid from a remotely-operated vehicle or other subsea container to be introduced into the hydraulic accumulator, wherein there are no hydraulic conduits extending from an above-sea or surface location.

4. The subsea grease injection system of claim 3, further comprising:

a valve positioned on the line between said hydraulic accumulator recharge and said hydraulic accumulator, said valve being movable between an open position and a closed position, the open position allowing the hydraulic fluid to be introduced into said hydraulic accumulator, the closed position blocking hydraulic fluid from flowing outwardly of said hydraulic accumulator to the hydraulic accumulator recharge.

5. The subsea grease injection system of claim 1, said subsea structure being a pressure control head.

6. The subsea grease injection system of claim 5, said pressure control head having a packoff hydraulic control therein.

7. The subsea grease injection system of claim 6, further comprising:

another hydraulic accumulator positioned remotely from said pressure control head, said another hydraulic accumulator adapted to controllably pass hydraulic fluid to said packoff hydraulic control of said pressure control head.

8. The subsea grease injection system of claim 7, said another hydraulic accumulator being pressurized, the subsea grease injection system further comprising:

a flow and pressure control device connected to a hose between said another hydraulic accumulator and said pressure control head, said flow and pressure control device adapted to control a flow rate and a pressure of the hydraulic fluid flowing to the packoff hydraulic control.

9. The subsea grease injection system of claim 7, further comprising:

a hydraulic accumulator recharge connected by line to said another hydraulic accumulator, said hydraulic accumulator recharge adapted to allow hydraulic fluid to be introduced into said another hydraulic accumulator.

10. A subsea lubrication system comprising:

a wellhead;

a well control package mounted on said wellhead;

a lubrication control package connected by a subsea connector to said well control package, said lubrication control package comprising:

a grease accumulator containing a supply of grease therein, said grease accumulator having a piston and a cylinder, the piston being received in the cylinder so as to define a first compartment and a second compartment therein, the supply of grease being in the first compartment;

a hydraulic accumulator having a hydraulic fluid therein, said hydraulic accumulator being in fluid communication with said grease accumulator such that the displacement of the hydraulic fluid from said hydraulic accumulator causes a corresponding discharge of grease from the supply of grease from said grease accumulator, the hydraulic fluid from said hydraulic accumulator filling an interior of the second compartment;

a flowline connected to an outlet of said grease accumulator so as to allow the discharge of grease from the supply of grease to flow therethrough;

a pressure control head connected by a lubricator section to said lubrication control package, said lubrication control package connected by the flowline to said pressure control head such that said pressure control head receives grease from said flowline;

an electrical power and communication downline connected to said well control package; and a flow and pressure control device mounted on the conduit, said flow and pressure control device regulating a flow rate and a pressure of the hydraulic fluid flowing through the conduit to the second compartment of said grease accumulator, said hydraulic accumulator being pressurized such the hydraulic fluid flows without a pump to said grease accumulator when said flow and pressure control device is opened.

11. The subsea lubrication system of claim 10, said well control package and said lubrication control package and said lubricator section and said pressure control head adapted to allow a subsea tool to pass therethrough.

12. The subsea lubrication system of claim 10, further comprising:

a hydraulic accumulator recharge connected by a line to said hydraulic accumulator, said hydraulic accumulator recharge adapted to allow hydraulic fluid from a remotely-operated vehicle or other subsea container to be introduced into the hydraulic accumulator, the subsea lubrication system further comprising:

a valve positioned on the line between said hydraulic accumulator recharge and said hydraulic accumulator, said valve being movable between an open position and a closed position, the open position allowing the hydraulic fluid to be introduced into said hydraulic accumulator, the closed position blocking hydraulic fluid from passing outwardly of said hydraulic accumulator to said hydraulic accumulator recharge.

13. The subsea lubrication system of claim 10, further comprising:

another hydraulic accumulator positioned remotely from said pressure control head, said another hydraulic accumulator adapted to controllably pass hydraulic fluid to a packoff hydraulic control of said pressure control head.

14. The subsea lubrication system of claim 13, said another hydraulic accumulator being pressurized, the subsea lubrication system further comprising:

a flow and pressure control device connected by a hose between said another hydraulic accumulator and said pressure control head, said flow and pressure control device adapted to control a flow rate and a pressure of the hydraulic fluid flowing to a packoff hydraulic control of the pressure control head.

15. The subsea lubrication system of claim 10, wherein said electrical power and communication downline extends only from a surface location, wherein no hydraulic conduit is required from the surface location.

16. The subsea lubrication system of claim 10, wherein said electrical power and communication downline extends from a surface or an above-surface location.

* * * * *